United States Patent [19]

Greffe

[11] 4,057,949

[45] Nov. 15, 1977

[54] BAGGING METHODS

[75] Inventor: Maurice F. Greffe, Meylan, France

[73] Assignee: Societe des Brevets Greffe, Meylan, France

[21] Appl. No.: 743,300

[22] Filed: Nov. 19, 1976

[30] Foreign Application Priority Data

Dec. 22, 1975 France ..... 75.39237

[51] Int. Cl.[2] ..... B65B 31/02

[52] U.S. Cl. ..... 53/22 B

[58] Field of Search ..... 53/7, 22 B, 46, 86, 53/112 B

[56] References Cited

U.S. PATENT DOCUMENTS

| | | | |
|---|---|---|---|
| 2,071,300 | 2/1937 | Gammeter | 53/22 B X |
| 2,875,070 | 2/1959 | Rockland et al. | 53/22 B X |
| 3,153,886 | 10/1964 | Christensson | 53/22 B |
| 3,196,587 | 7/1965 | Hayward et al. | 53/22 B X |

FOREIGN PATENT DOCUMENTS

| | | | |
|---|---|---|---|
| 855,313 | 11/1960 | United Kingdom | 53/22 B |

*Primary Examiner*—Travis S. McGehee
*Attorney, Agent, or Firm*—Darby & Darby

[57] ABSTRACT

An improved method for bagging material, particularly granular material in which the material is first placed into a bag, the bag is closed by bringing the lips of the open end together and folding them over, preferably with a double fold, a discontinuous seal is then made along the closure, the bag is then subjected to atmospheric pressure.

12 Claims, 8 Drawing Figures

BAGGING METHODS

The present invention relates to the packaging of various products, and particularly powdered or granulated products, in tight bags.

One of the problems which comes up in packaging in tight bags is how to empty the bags of their contents of air so that they may be suitably stacked, so they will occupy a minimum of space and will retain a given shape in the course of the handling to which they are subjected.

This problem is all the more important when it is a question of very fine or micronized powders whose mass contains occluded air. This air is, moreover, often necessary for the handling of the product by means such as fluidification, and in the absence of this air the product would form a compact mass exhibiting many difficulties. However, once the product is bagged, it is necessary to empty the bag not only of the air situated above the product, but also the air separating the grains of the product and mixed in the mass. The final volume of the product is then considerably smaller and the combination of the bag and product becomes compact.

One solution consists in operating the bagging by welding in a vacuum, but this solution, particularly when it is a question of bags with a capacity exceeding several $dm^3$, involves cumbersome installations which are not justified by all sorts of products. Also proposed has been making orifices in the bag, then placing the bag in a vacuum after welding shut, and then plugging the orifices. But in the course of degassing, some of the product will escape through the holes, particularly in the case of powders, and it is practically impossible to plug the holes in a satisfactory manner.

To remedy these drawbacks, the invention envisages the method of bagging which consists in embodying the closure of the bags previously filled, by bringing the lips of the opening together and folding them over themselves, then in providing on the fold thus obtained, a discontinuous seal by means such as staples, eyelets or discontinuous welding, finally subjecting the bags to the action of a measured vacuum, and then bringing them back to atmospheric pressure.

Experience has shown that this method makes it possible to empty the bags completely of the air which they contain, without having the product escape, even if it is in the form of micronized powder.

Furthermore, the operation is simple and can be embodied with relatively inexpensive installations.

The invention also envisages the following preferred arrangements:

a. The lips of the bag are the object of at least a double fold before sealing.

b. During the operation of applying the vacuum, the bags are placed with their closure upward to avoid clogging the interstices by the product contained in the bag.

c. The vacuum is on the order of at least 300 mm Hg.

d. The bags are brought into shape before or after closing, but before the operation of evacuation.

The invention is illustrated by the attached drawing in which.

Figure 1:
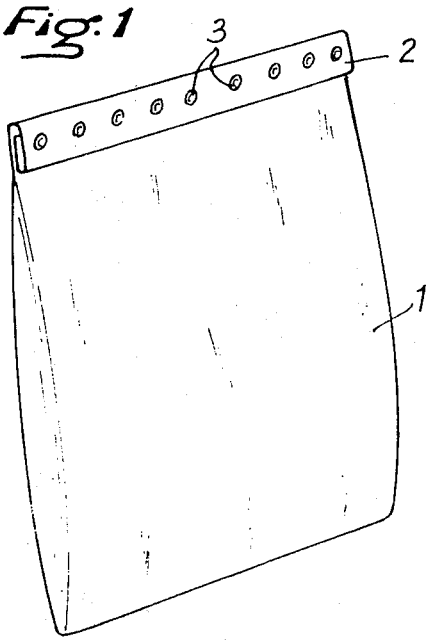
FIG. 1 is a perspective view of a bag prepared according to the invention.
Figure 2:
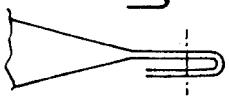
FIG. 2 to 6 illustrate, in schematic section, various folding solutions suitable for the method of the invention.
Figure 3:
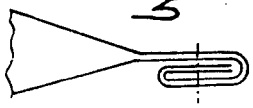
Figure 4:
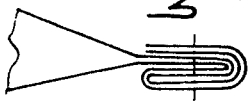
Figure 5:
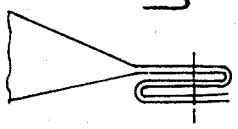
Figure 6:
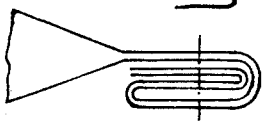

Referring to FIG. 1, we see that, according to the invention, the bag, 1, once it is filled, is closed by bringing together the lips of the bag, and folding them over on themselves, as represented in FIG. 2, then providing a discontinuous sealing 3 on fold 2.

In the example represented, it is a question of sealing by eyelets, but we can also operate by stapling or discontinuous welding. Where the bag is of plastic material, the welding is commonly called heat-sealing.

Figure 7:
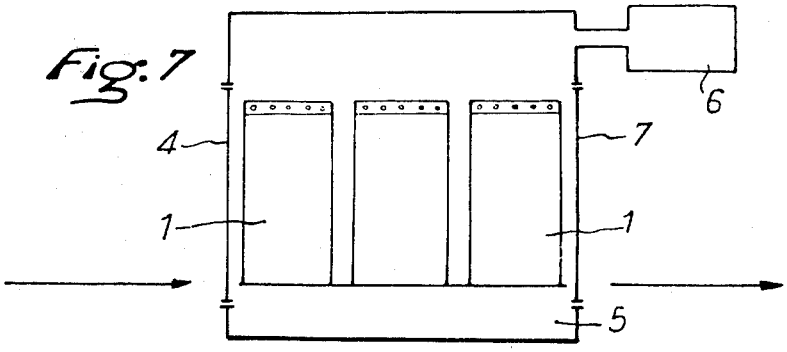
FIG. 7 and 8 illustrate, schematically, two methods of application of the process according to the invention.
Figure 8:
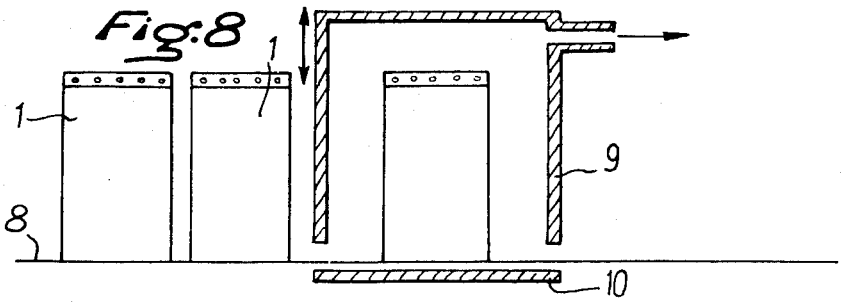

The bags are then subjected to a vacuum, for example, by means as represented in FIG. 7 and 8.

In FIG. 7, the bags 1 are introduced at 4 into the chamber which is then closed and connected with a source of vacuum 6. The vacuum will preferably be on the order of 30 to 50 cm (300 to 500 mm) of mercury below atmospheric pressure, and can be maintained according to the nature of the bagged product and the tightness of the closure, for between a few seconds and half a minute or even one minute, approxiamtely.

The bags are then withdrawn at 7 from chamber 5.

FIG. 8 illustrates a continuous process, in which the bags 1 move on a conveyer belt 8 to pass, for example, by a step-by-step action, into a vacuum belt 9 which rises and falls on a plate 10.

FIG. 2 to 6 illustrate the styles of folding which can be adopted according to the products to be bagged, and in particular according to their fineness. As represented, the fold can be simple (FIG. 2), or double (FIGS. 3 and 5) with three thicknesses of the double walls, or again folded on itself (FIG. 4) or folded over (FIG. 6) with four thicknesses of the double walls.

Increasing the number of folds increases the tightness and the strength of the closure.

When the bags are subjected to the vacuum, the product tends to clog up the folds. It is therefore preferable to work with the bags upright. Furthermore, when the vacuum is applied, the shape of the bags tends to stabilize, and this is why, according to the invention, we operate preferably as follows: the bag is filled and closed, and it is then shaped, for example, by compression between the two walls or two strips. The closure can also take place after the shaping. The bag is then subjected to the vacuum. It is finally returned to atmospheric pressure.

Experience teaches that the bag then retains its shape, and that air does not manage to re-enter the bag except in very small quantities, since the closure acts as a sort of valve.

As indicated above, the process according to the invention applies to all sorts of products, and particularly to food products (powdered milk, chocolate, coffee, etc.) and to chemical products (fertilizers, fungicides, etc.). It also applies to all sorts of tight bags such as those which serve for the packaging of the products cited above and which can comprise a superposition of layers of paper, aluminum, plastic, plastified, tarred or aluminized, etc. paper.

By way of example, we will indicate that a packaging of food products can be embodied by means of an inner pouch of plastic material contained in a bag formed of 6 layers of paper, one layer of which is aluminized and one layer tarred.

The invention envisages, by way of new industrial products, the products resulting from the process according to the invention, that is to say, the bags closed by folding the lips of the opening on themselves with discontinuous sealing of the fold thus obtained, and practically emptied of air.

What is claimed is:

1. A method of bagging material in a bag to reduce the quantity of air trapped in the bag comprising the steps of:

filling a quantity of material in the bag, forming a closure for the previously filled bag by a. first bringing the lips of the bag opening together and folding the lips over on themselves to form a fold area and, b. then providing a plurality of seals spaced apart along the fold area subjecting the bag to a reduced pressure to deaerate it through the closure, and subjecting the bag to atmospheric pressure, the said closure forming an obstacle to the intrusion of the outside gases.

2. A method according to claim 1, wherein the step of forming the closure comprises forming the lips of the bag with at least one double fold before providing the seals.

3. A method according to claim 1 wherein during the step of subjecting the bag to the reduced pressure the bag is placed with its closure facing upward to avoid the clogging of the interstices between the seals by the material contained in the bag.

4. A method according to claim 1, wherein the step of subjecting the bag to the reduced pressure comprises providing a pressure in the order of at least 300 mm Hg or less.

5. A method according to claim 1 further comprising the step of shaping the bag before forming the closure and before a subjecting it to the reduced pressure.

6. A method according to claim 1 further comprising the step of shaping the bag after forming the closure but before subjecting it to the reduced pressure.

7. A method as in claim 1 when the step of forming the seals comprises making the seals by mechanical means.

8. A method as in claim 1 wherein the bag is of plastic material and the step of forming the seals comprises heat-sealing selected portions of the fold area.

9. A method according to claim 2 wherein the lips of the bag are formed with at least two double folds before sealing.

10. A method according to claim 1 wherein the step of subjecting the bag to a reduced pressure comprises placing the entire bag in a chamber of reduced pressure.

11. A method as in claim 7 wherein the step of making the seals by mechanical means comprises making the seal by stapling.

12. A method as in claim 7 when the step of making the seals by mechanical means comprises providing a number of eyelets.

* * * * *